US008790135B2

(12) United States Patent
Maegawa

(10) Patent No.: US 8,790,135 B2
(45) Date of Patent: Jul. 29, 2014

(54) INSERT MOLDED CONNECTOR

(75) Inventor: Akihito Maegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 54 days.

(21) Appl. No.: 13/530,700

(22) Filed: Jun. 22, 2012

(65) Prior Publication Data

US 2013/0017720 A1 Jan. 17, 2013

(30) Foreign Application Priority Data

Jul. 13, 2011 (JP) ..... 2011-154642

(51) Int. Cl.
*H01R 13/40* (2006.01)

(52) U.S. Cl.
USPC ..... 439/587; 439/246; 439/883

(58) Field of Classification Search
USPC ..... 439/595, 587, 801, 883, 736, 246, 845
See application file for complete search history.

(56) References Cited

U.S. PATENT DOCUMENTS

| | | | | | |
|---|---|---|---|---|---|
| 2,264,040 | A | * | 11/1941 | Johnson et al. | 439/222 |
| 3,090,936 | A | * | 5/1963 | Maitby | 439/595 |
| 3,541,229 | A | * | 11/1970 | De Smidt | 174/135 |
| 3,676,833 | A | * | 7/1972 | Johnson | 439/295 |
| 3,864,000 | A | * | 2/1975 | Coller et al. | 439/246 |
| 3,971,613 | A | * | 7/1976 | Kobler | 439/595 |
| 4,013,331 | A | * | 3/1977 | Kobler | 439/595 |
| 4,085,989 | A | * | 4/1978 | McCardell | 439/595 |
| 4,972,576 | A | * | 11/1990 | Sloppy et al. | 29/884 |
| 5,063,314 | A | * | 11/1991 | DeSantis | 310/71 |
| 5,076,796 | A | * | 12/1991 | Kusayanagi et al. | 439/83 |
| 5,173,060 | A | * | 12/1992 | Shimirak et al. | 439/416 |
| 5,197,903 | A | * | 3/1993 | Casey et al. | 439/564 |
| 5,417,587 | A | * | 5/1995 | Katsuda et al. | 439/559 |
| 6,280,208 | B1 | * | 8/2001 | Masuda et al. | 439/98 |
| 6,464,538 | B2 | * | 10/2002 | Miyazaki et al. | 439/607.44 |
| 6,595,789 | B2 | * | 7/2003 | Oota et al. | 439/98 |
| 6,695,632 | B2 | * | 2/2004 | Matsumoto et al. | 439/246 |
| 6,702,612 | B2 | * | 3/2004 | Miyazaki et al. | 439/559 |
| 6,815,610 | B2 | * | 11/2004 | Kuboshima et al. | 174/360 |
| 6,821,160 | B2 | * | 11/2004 | Fink et al. | 439/701 |
| 6,905,375 | B2 | * | 6/2005 | Ikeda | 439/801 |
| 6,921,292 | B2 | * | 7/2005 | Miyazaki | 439/564 |
| 6,991,493 | B2 | * | 1/2006 | Matsui et al. | 439/579 |
| 7,070,449 | B2 | | 7/2006 | Miyazaki | |
| 7,084,727 | B2 | * | 8/2006 | Bauer et al. | 335/132 |
| 7,530,843 | B1 | * | 5/2009 | Tesfay et al. | 439/587 |
| 7,572,150 | B2 | * | 8/2009 | Matsuoka | 439/626 |
| 8,342,880 | B2 | * | 1/2013 | Kato et al. | 439/595 |
| 8,366,470 | B2 | * | 2/2013 | Sakakura | 439/272 |
| 8,435,040 | B2 | * | 5/2013 | Costabel et al. | 439/34 |

* cited by examiner

*Primary Examiner* — Tulsidas C Patel
*Assistant Examiner* — Phuongchi T Nguyen
(74) *Attorney, Agent, or Firm* — Gerald E. Hespos; Michael J. Porco; Matthew T. Hespos

(57) ABSTRACT

A connector (C) is formed by insert molding such that terminal fittings (10) are embedded in a housing (20). A connecting portion (10A) provided at the front end of the terminal fitting (10) for connection to a mating terminal fitting projects forward from the housing (20) and a part of the terminal fitting (10) located behind the connecting portion (10A) is embedded in the housing (20). A seal (15) is provided in close contact with an embedded portion (10C) of the terminal fitting (10) embedded in the housing (20) and a resilient portion (19) is provided at a position before the seal (15) and outside the housing (20).

13 Claims, 8 Drawing Sheets

INSERT MOLDED CONNECTOR

BACKGROUND OF THE INVENTION

1. Field of the Invention

The invention relates to a connector.

2. Description of the Related Art

Known connectors are formed by insert molding so that part of a terminal fitting is embedded in a housing. More particularly, a connecting portion is provided at the front end of the terminal fitting and projects forward from the housing for connection to a mating terminal fitting and a part behind the connecting portion is embedded in the housing. A clearance may be formed in an adhering part of the terminal fitting and the housing of the insert molded connector due to low adhesion between two materials. Accordingly, water or oil may intrude into the housing through that clearance.

U.S. Pat. No. 7,070,449 discloses adhering a seal to the outer peripheral surface of a part of a terminal fitting to be embedded in a housing and then performing insert-molding to ensure good waterproofing. However, waterproof performance may be reduced by a stress produced in the seal due to a force acting on a connecting portion of the terminal fitting, for example, during a connecting operation to a mating terminal fitting.

The invention was completed in view of the above and an object thereof is to provide a connector capable of preventing a reduction in waterproof performance.

SUMMARY OF THE INVENTION

The invention relates to a connector formed by insert molding so that at least one terminal fitting is embedded partly in a housing. A connecting portion is provided at one part of the terminal fitting for connection to a mating terminal fitting and projects out from the housing and a part of the terminal fitting adjacent the connecting portion is embedded in the housing. At least one seal is provided in close contact with an embedded portion of the terminal fitting embedded in the housing and at least one resilient portion is provided between the connecting portion and the seal and outside the housing.

A force on the connecting portion deforms the resilient portion, but does not affect the seal. As a result, a force acting on the connecting portion will not produce a stress in the seal that could reduce fluidproof performance.

The embedded portion of the terminal fitting may include at least one retaining portion that increases an adhesion or connection force between the terminal fitting and the housing. Thus, an axial force on the connecting portion is received by the retaining portion and less of the axial force is transmitted to the seal. Thus, an axial force on the connecting portion will not produce a stress in the seal, and hence waterproof performance is not reduced.

The connecting portion may be vertically in contact with and connected to the mating terminal fitting. Thus, the resilient portion may have a smaller vertical dimension than a part behind the resilient portion. The resilient portion is deformed resiliently if a vertical force acts on the connecting portion and the vertical force transmitted to the seal can be reduced. As a result, a vertical force on the connecting portion will not produce a stress in the seal and waterproof performance is not reduced.

The embedded portion of the terminal fitting may include at least one retaining projection. The embedded portion may be substantially cylindrical and the retaining projection may have a receiving surface extending in a direction crossing a circumferential direction of the embedded portion. The receiving surface of the retaining projection receives a rotational force of the terminal fitting, thereby reducing the rotational force transmitted to the seal. As a result, a rotational force on the connecting portion will not produce a stress in the seal and waterproof performance is not reduced.

The embedded portion of the terminal fitting may include at least one retaining portion having an irregular shape. The retaining portion may include two projections projecting out from the embedded portion in a width direction and located at positions substantially facing each other in the width direction of the embedded portion. This configuration is advantageous in terms of strength as compared with the case where a retaining portion is provided by making part of the embedded portion smaller in width than other parts. Additionally, an adhesion force to the housing is increased as compared with the case where a projection is provided on only one side of the embedded portion. Therefore, a force transmitted to the seal can be reduced more.

The terminal fitting may be substantially symmetrical in the width direction.

The connecting portion may be a plate having a vertical thickness smaller than the embedded portion and a width larger than the embedded portion.

The terminal fitting preferably comprises a wire-side connecting portion for connection to a wire or a wire-side connector. The seal preferably is slightly closer to the wire-side connecting portion than to a central position of the embedded portion in forward and backward directions.

The resilient portion preferably has a smaller vertical dimension than the embedded portion or the wire-side connecting portion.

The terminal fitting preferably comprises at least one rigidity-reduced portion behind the resilient portion. The rigidity-reduced portion has a rigidity reduced from the embedded portion toward the connecting portion, is provided. The resilient portion preferably is at a front end part of the rigidity-reduced portion.

A width of the rigidity-reduced portion preferably is increased from the embedded portion toward the device-side connecting portion.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
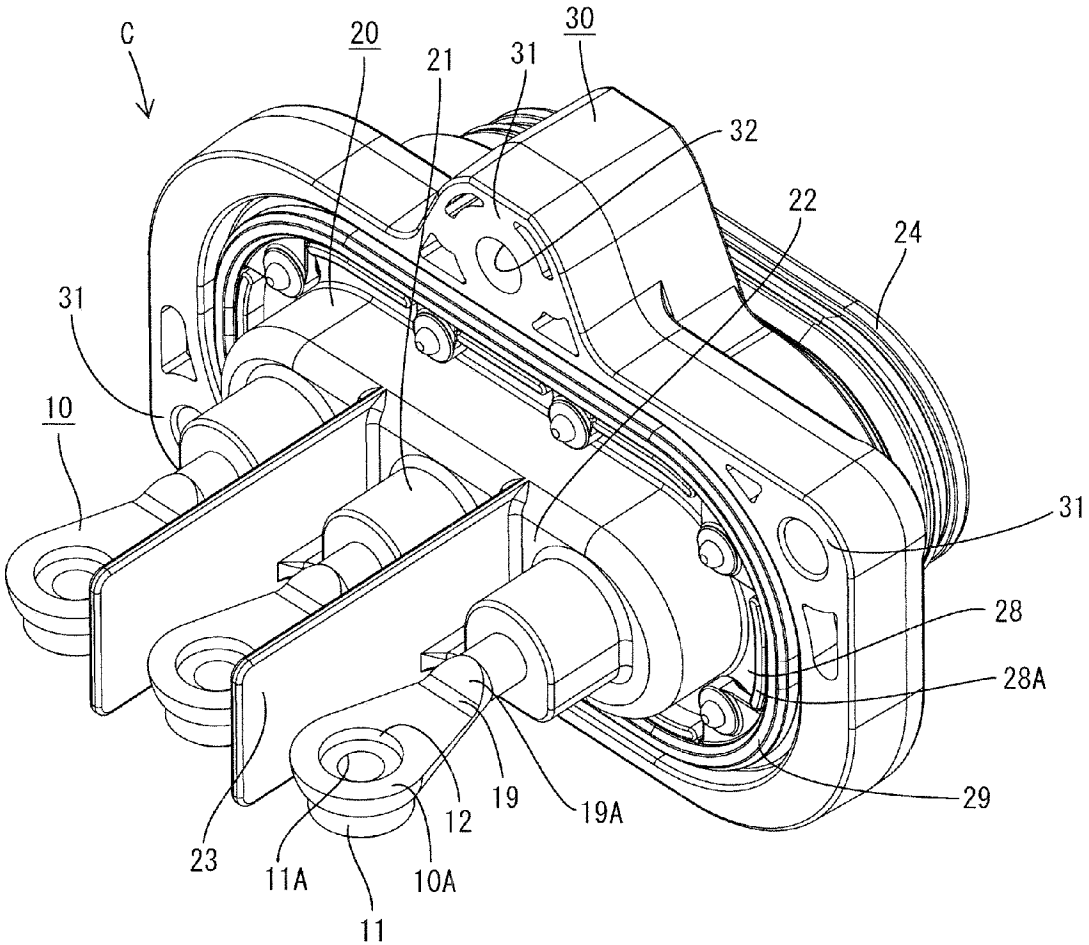
FIG. 1 is a perspective view of a connector according to an embodiment.
Figure 2:
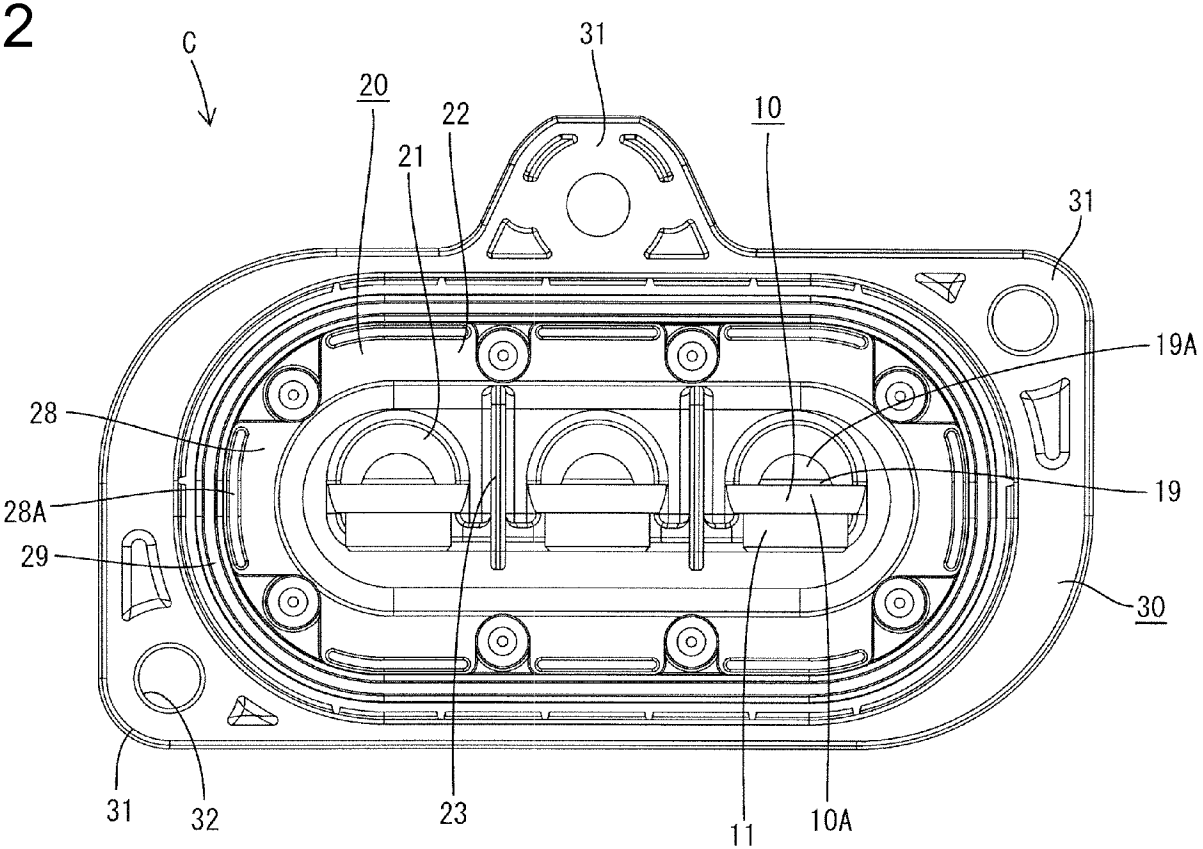
FIG. 2 is a front view of the connector.
Figure 3:
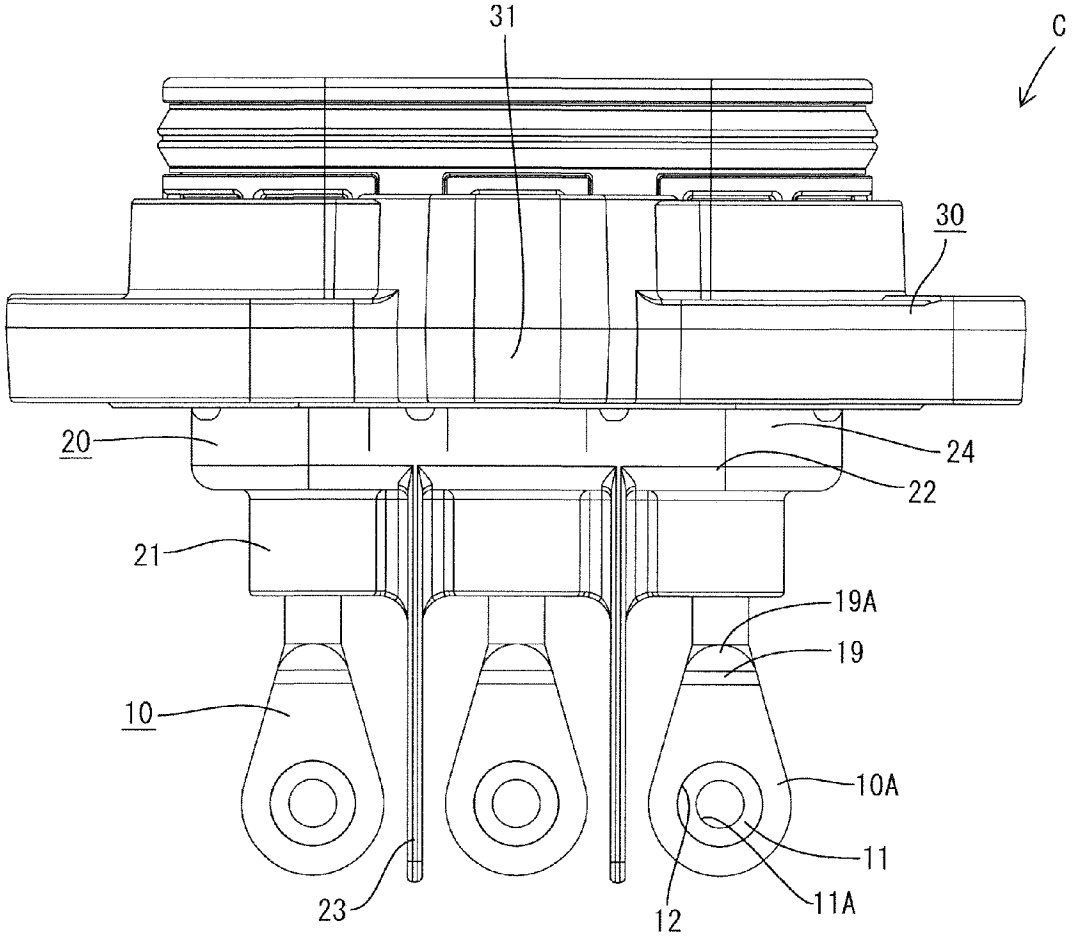
FIG. 3 is a plan view of the connector.

A connector C in this embodiment is a device connector used to supply power to an unillustrated load or device (e.g. motor mounted in an electric vehicle, a hybrid vehicle or the like). In the following description, an end (front of FIG. 1) to be connected with the device is referred to as the front, an opposite end is referred to as the rear, and upper and lower sides of FIG. 1 are referred to as the top and bottom for respective constituent members. Note that the device is to be housed in an unillustrated conductive metal case having a shield function and the connector C is to be mounted in a mounting hole in the case.

The connector C has terminal fittings 10 with embedded portions embedded in a housing 20 by insert molding so that a unitary matrix of synthetic resin surrounds and engages parts of the terminal fittings 10.

As shown in FIG. 1, the housing 20 has substantially cylindrical terminal holding portions 21 and substantially central portions of the terminal fittings 10 are embedded in the terminal holding portions 21. The terminal holding portions 21 are arranged in a row and are joined unitarily by a connecting wall 22 (see FIG. 5). The connecting wall 22 has an elliptical shape that is long in a width direction of the connector C when viewed from the front.

Figure 4:
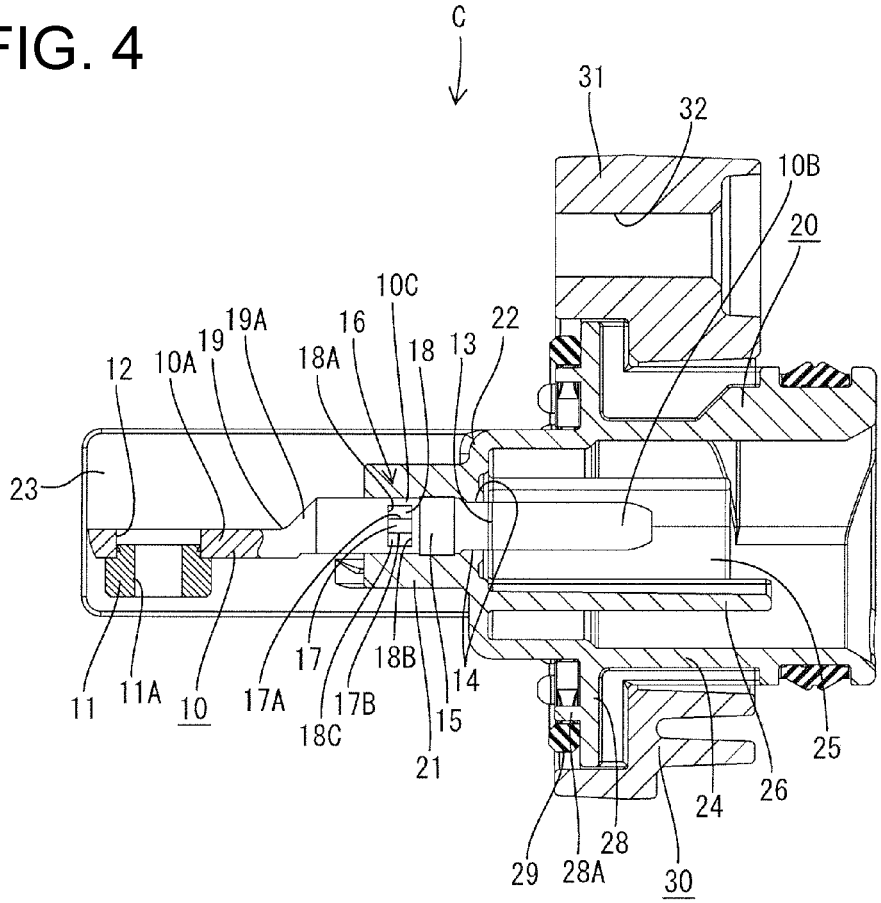
FIG. 4 is a side view in section of the connector.
Figure 5:
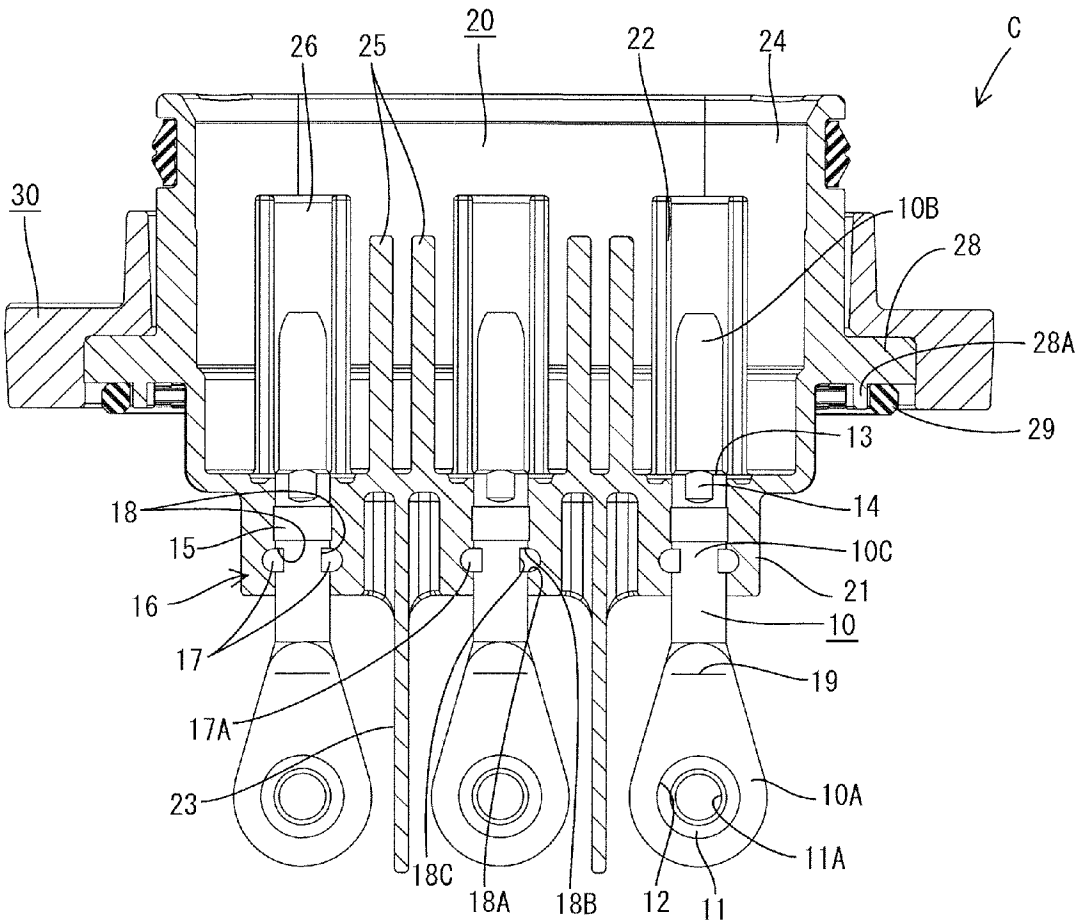
FIG. 5 is a plan view in section of the connector.

Device-side partition walls 23 are provided on the front side of the connecting wall 22 for partitioning and insulating between device-side connecting portions 10A of the adjacent terminal fittings 10 (see FIG. 5). The device-side partition walls 23 are thin substantially rectangular plates long in forward and backward directions and project substantially perpendicularly from the connecting wall 22. The front ends of the device-side partition walls 23 are slightly before the device-side connecting portions 10A of the terminal fittings 10 (see FIG. 4).

A receptacle 24 is provided on the rear of the connecting wall 22 for receiving a wire-side connector connected to ends of unillustrated wires. The receptacle 24 is substantially tubular and wire-side connecting portions 10B of the terminal fittings 10 are arranged in a row inside the receptacle 24 (see FIG. 5).

Wire-side partition walls 25 and projections 26 project into the receptacle 24 from the rear of the connecting wall 22. The wire-side partition walls 25 partition and insulate between the wire-side connecting portions 10B of the adjacent terminal fittings 10. The projections 26 are substantially right below the wire-side connecting portions 10B.

The wire-side partition walls 25 are thin rectangular thin plates that are long in forward and backward directions and project substantially perpendicularly from the connecting wall 22. Two wire-side partition walls 25 are provided between a pair of adjacent wire-side connecting portions 10B. Rear ends of the wire-side partition walls 25 are behind the wire-side connecting portions 10B of the terminal fittings 10.

The wire-side partition walls 25 and the device-side partition walls 23 are displaced in the width direction of the connector C so that each device-side partition wall 23 is between a corresponding pair of wire-side partition walls 25. The wire-side partition walls 25 are thicker than the device-side partition walls 23.

A flange 28 is provided on the housing 20 and is to be arranged along an outer side surface of the case. The flange 28 is a plate that projects out over substantially the entire periphery at a substantially middle position of the housing 20 in forward and backward directions.

A projecting wall 28A projects from the front surface of the flange 28 at a position slightly inwardly of the outer peripheral edge of the flange 28, and a seal ring 29 is mounted between the outer peripheral edge of the flange 28 and the projecting wall 28A. The seal ring 29 is pressed against the outer side surface of the case when the connector C is mounted into the mounting hole in the case.

A shield shell 30 is mounted on the housing 20. The shield shell 30 is made of aluminum die-cast and covers substantially the entire flange 28 and part of the receptacle 24. Fixing portions 31 are provided at plural positions of the shield shell 30, and an insertion hole 32 is arranged at a position in each fixing portion 31 corresponding to a fixing hole. The shield shell 30 is fixed electrically conductively to the case by inserting unillustrated metal bolts into the respective insertion holes 32 and tightening the bolts into the fixing holes of the case.

As shown in FIG. 4, the terminal fitting 10 held in the housing 20 is long and narrow in forward and backward directions. A device-side connecting portion 10A is formed at one end of the terminal fitting 10 and is to be connected electrically to an unillustrated device-side terminal fitting and the wire-side connecting portion 10B at the other end of the terminal fitting 10 is to be connected electrically to the unillustrated wire-side connector. The wire-side connecting portion 10B is a round pin and projects back from the connecting wall 22. The embedding portion 10C is at an intermediate part between the connecting portions 10A, 10B and is to be embedded in the housing 20. Each terminal fitting 10 is substantially symmetrical in the width direction as shown in FIG. 5.

The device-side connecting portion 10A is a plate having a vertical thickness smaller than (particularly less than about two thirds, e.g. about half) the embedded portion 10C and a larger width than the embedded portion 10C. A through hole 12 into which a nut, such as a self-locking nut 11, is press-fit is formed substantially in the center of the device-side connecting portion 10A.

The self-locking nut 11 is made of metal and is substantially in the form of a ring formed with a screw hole 11A substantially in its center. A central part of the self-locking nut 11 projects more in an axial direction than the other part, and the self-locking nut 11 is to be fixed to the device-side connecting portion 10A by press-fitting this projecting part into the through hole 12 (see FIG. 4).

The terminal fitting 10 is held and oriented in the housing 20 so that the screw hole 11A of the self-locking nut 11 extends substantially vertically and the self-locking nut 11 is below the device-side connecting portion 10A. The device-side terminal fitting is to be placed on and the upper surface of the device-side connecting portion 10A and connected to the device-side connecting portion 10A by inserting a shaft of a bolt into a through hole of the device-side terminal fitting and the through hole 12 of the device-side connecting portion 10A and threadedly engaging the shaft with the screw hole 11A of the self-locking nut 11.

The embedded portion 10C is substantially a cylinder with a slightly larger diameter than the wire-side connecting portion 10B and a step 13 is formed on a boundary between the embedded portion 100 and the wire-side connecting portion 10B. The step 13 is at the rear of the connecting wall 22 (see FIG. 5). Dents 14 are formed in upper and lower sides of a rear of the embedded portion 10C. The dents 14 are in a substantially widthwise central part of the embedded portion 10C and have depths to be substantially flush with the outer peripheral surface of the wire-side connecting portion 10B.

A seal 15 is provided in close contact with the embedded portion 10C. The seal 15 is formed by applying a resilient material (such as a rubber adhesive) to the outer peripheral surface of the embedded portion 10C before the housing 20 is formed by insert molding. The seal 15 is slightly closer to the wire-side connecting portion 10B than to a central position of the embedded portion 100 in forward and backward directions. The seal 15 seals a clearance between the embedded portion 10C and the housing 20 in a fluid- or liquid-tight manner so that a liquid (e.g. oil in the case) on the device-side connecting portion 10A that may penetrate into the clearance between the terminal fitting 10 and the housing 20 from the front end surface of the housing 20 is blocked by the seal 15 and cannot reach the wire-side connecting portion 10B.

An irregularly shaped retaining portion 16 is formed on a side of the embedded portion 10C before the seal 15. The retaining portion 16 is formed by forging and includes projections 17 that project out from recesses 18 formed in the embedded portion 10C. The projections 17 are at opposite positions in a width direction of the embedded portion 10C.

Figure 6:
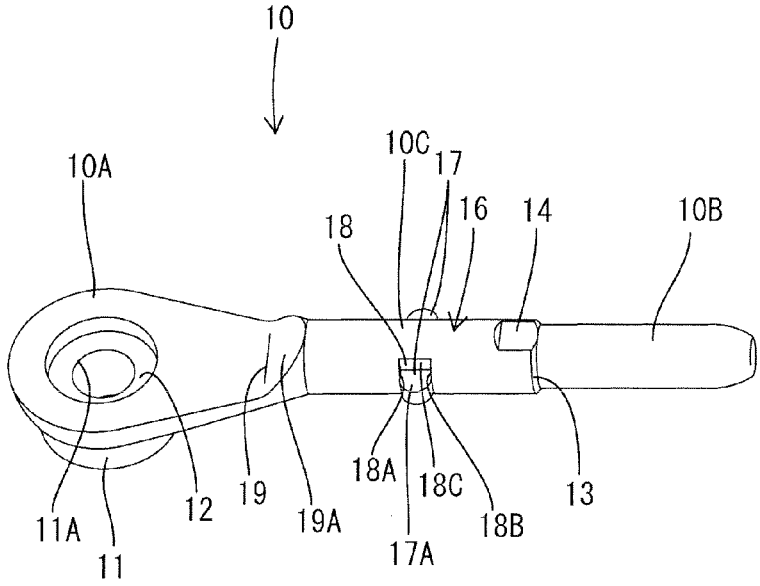
FIG. 6 is a perspective view of a terminal fitting.
Figure 7:
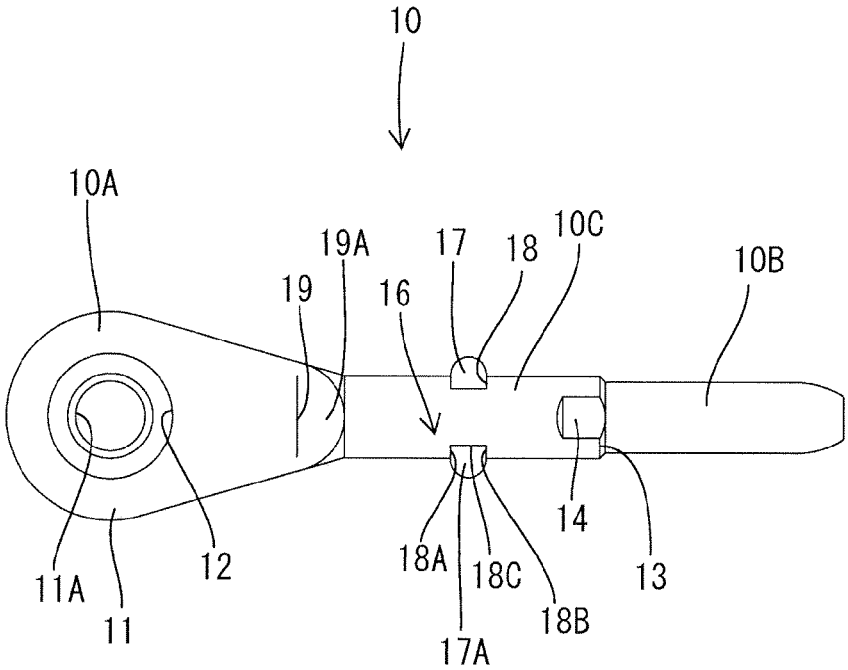
FIG. 7 is a plan view of the terminal fitting.

The recess 18 is recessed in from the outer peripheral surface of the embedded portion 10C and is open sideways while being enclosed on three sides by a front surface 18A, a rear surface 18B and a side surface 18C (see FIG. 6). The front and rear surfaces 18A, 18B of the recess 18 are substantially parallel, and the side surface 18C is substantially perpendicular to the surfaces 18A, 18B (see FIG. 7). The recess 18 extends substantially vertically from a position near the upper end of the embedded portion 100 to a position near the lower end thereof (see FIG. 8).

Figure 8:
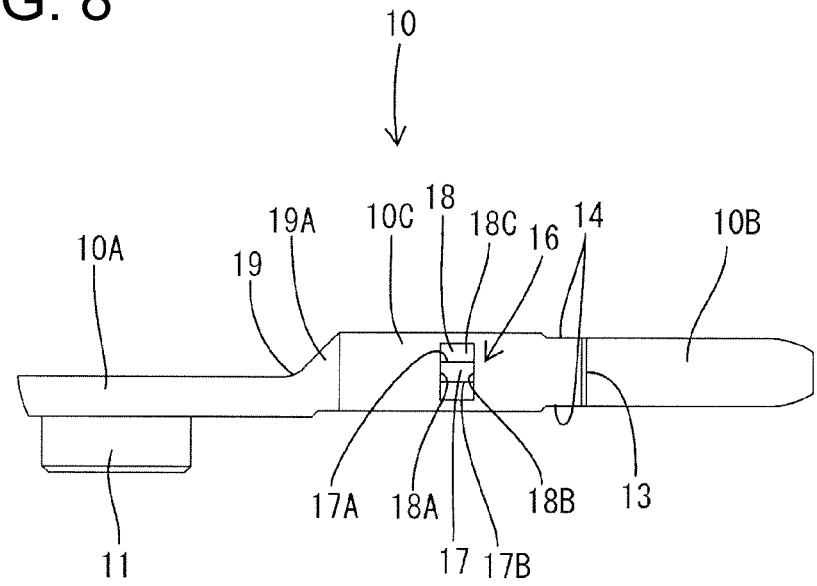
FIG. 8 is a side view of the terminal fitting.

The projection 17 is at a substantially central position of the each recess 18 in the vertical direction (see FIG. 8). The projection 17 projects sideways from the side surface 18C of the recess 18 and a portion (particularly more than one third, e.g. about a half) thereof projects out from the embedded portion 10C (see FIG. 7). The outer peripheral surface of a part of the projection 17 that projects out from the embedded portion 10C is arcuate. A part of the projection 17 arranged in the recess 18 of the embedded portion 10C is substantially rectangular in plan view and is connected to the front surface 18A, the rear surface 18B and the side surface 18C of the recess 18.

Upper and lower surfaces 17A and 17B (as exemplary receiving surface(s)) of the projection 17 are substantially flat and extend in a direction crossing a circumferential direction of the embedded portion 10C and substantially perpendicular to the side surface 18C of the recess 18 (see FIG. 8). A vertical dimension of the projection 17 is about ⅓ of the vertical dimension of the side surface 18C of the recess 18.

A resilient portion 19 is provided between the embedded portion 100 and the device-side connecting portion 10A and is at a position on the terminal fitting 10 before the seal 15 and outside the housing 20 (see FIG. 4). The resilient portion 19 has a smaller vertical dimension than the embedded portion 10C and the wire-side connecting portion 10B and easily is deformed resiliently.

At least one rigidity-reduced portion 19A is provided behind the resilient portion 19 and has rigidity reduced gradually from the embedded portion 10C toward the device-side connecting portion 10A. The resilient portion 19 is at the front end of the rigidity-reduced portion 19A. The lower surface of the rigidity-reduced portion 19A is substantially parallel to the lower surface of the device-side connecting portion 10A, but the upper surface is inclined down toward the front. In this way, the thickness of the rigidity-reduced portion 19A is reduced gradually from the embedded portion 10C toward the device-side connecting portion 10A and, accordingly, rigidity in the vertical direction is reduced gradually. The width of the rigidity-reduced portion 19A is increased gradually from the embedded portion 100 toward the device-side connecting portion 10A, as shown in FIG. 5. Note that the width of the device-side connecting portion 10A is increased gradually from the resilient portion 19 to a position of the device-side connecting portion 10A where the width is largest, and the entire device-side connecting portion 10A including the resilient portion 19 has a substantially teardrop appearance.

The connector C of this embodiment is formed by insert molding so that the terminal fittings 10 are embedded partly in the housing 20. The device-side connecting portion 10A at the front end of each terminal fitting 10 projects forward from the housing 20 and the part of each terminal fitting 10 behind the device-side connecting portion 10A is embedded in the housing 20. A seal 15 is provided in close contact with the embedded portion 10C of the terminal fitting 10 embedded in the housing 20 and the resilient portion 19 is provided before the seal 15 and outside the housing 20.

In this way, even if a lateral or vertical force acts on the device-side connecting portion 10A e.g. in bolting the device-side terminal fitting and the device-side connecting portion 10A, the force is unlikely to be transferred to the seal 15 since the resilient portion 19 is resiliently deformed in the lateral or vertical direction. Thus, a force acting on the device-side connecting portion 10A will not produce a stress in the seal 15 and hence will not reduce a waterproof performance.

The embedded portion 10C of the terminal fitting 10 includes the irregularly shaped retaining portion 16 that increases an adhesion force between the terminal fitting 10 and the housing 20. Thus, the retaining portion 16 receives an axial force caused by pulling the device-side connecting portion 10A or the wire-side connecting portion 10B after the connector C is connected to the wire side and the device side. Therefore the axial force transmitted to the seal portion 15 can be reduced so that waterproof performance is not impaired by an axial force acting on these connecting portions 10A, 10B.

The embedded portion 10C is substantially cylindrical and the retaining portion 16 has upper and lower surfaces 17A, 17B extending in directions crossing the circumferential direction of the embedded portion 10C. In this way, the upper or lower surfaces 17A or 17B of the retaining portion 16 receive a rotational force exerted on the device-side connecting portion 10A or the wire-side connecting portion 10B after the connector C is connected to the wire side and the device side. Therefore, the rotational force is not transmitted to the seal 15 and waterproof performance is not reduced by a stress in the seal 15 caused by a rotational force on the connecting portions 10A, 10B.

The retaining portion 16 has projections 17 projecting out from the embedded portion 10C at opposite positions in the width direction of the embedded portion 10C. This is advantageous in terms of strength, for example, as compared with the case where a part of the embedded portion is made smaller in width than the other part and only that width-reduced part serves as a resilient portion without providing any projection. An adhesion force to the housing 20 is increased as compared with the case where a projection is provided only on one side of the embedded portion. Therefore, a force transmitted to the seal 15 can be reduced more.

The invention is not limited to the above described embodiment. For example, the following embodiments also are included in the scope of the invention.

The seal 15 is formed by applying the rubber adhesive to the outer peripheral surface of the embedded portion 10C in the above embodiment. However, a resilient member (such as a rubber ring) may be mounted on the outer peripheral surface of the embedded portion as a seal or may be bonded to the outer peripheral surface of the embedded portion by an adhesive.

The retaining portion 16 is provided on the side of the embedded portion 100 before the seal 15 in the above embodiment. However, the retaining portion may be provided behind the seal or may be provided at each of front and rear sides of the seal.

The device-side connecting portion 10A is thinner than the embedded portion 10C and the rigidity-reduced portion 19A is thinned gradually from the embedded portion 10C toward the resilient portion 19. However, if the device-side connecting portion is thicker than or as thick as the embedded portion, the gradually thinned rigidity-reduced portion from the device-side connecting portion or the embedded portion toward the resilient portion may be provided at each of front and rear sides of the resilient portion.

The retaining portion 16 includes the projections 17 projecting out from the embedded portion 100 in the above embodiment. However, the retaining portion may have any arbitrary shape provided that an axial force acting on the terminal fitting can be received. For example, a part of the embedded portion may be narrower than the other part and only this part may serve as the retaining portion.

The projection 17 projects out from the recess 18 in the above embodiment. However, the projection may be accommodated in the recess.

The projection 17 has upper and lower surfaces 17A, 17B intersecting the circumferential direction of the embedded portion 100 in the above embodiment. However, the outer peripheral surface of the projection may be arcuate or bent in or tangential to the circumferential direction of the embedded portion.

Although the projection 17 is provided in the recess 18 formed in the embedded portion 10C in the above embodiment, there is no limitation to this. For example, the projection may project on the outer peripheral surface of the embedded portion without providing the recess in the embedded portion.

What is claimed is:

1. An insert molded connector, comprising:

a housing molded from a synthetic resin; and at least one terminal fitting having:

an embedded portion insert molded in the housing;

a connecting portion projecting out from the housing and being configured for connection to a mating terminal fitting;

at least one seal in close contact with the embedded portion of the terminal fitting so that the seal is surrounded completely by the synthetic resin of the housing; and at least one resilient portion at a position between the connecting portion and the seal and outside the housing.

2. The connector of claim 1, wherein the terminal fitting is substantially symmetrical in a width direction.

3. The connector of claim 1, wherein the terminal fitting comprises a wire-side connecting portion projecting from an end of the housing opposite the connecting portion and configured for connection to a wire or a wire-side connector, the seal being slightly closer to the end of the housing from which the wire-side connecting portion projects than to an end of the housing from which the connecting portion projects.

4. The connector of claim 1, wherein the resilient portion has a smaller vertical dimension than the embedded portion and the wire-side connecting portion.

5. The connector of claim 1, wherein the embedded portion of the terminal fitting includes at least one non-cylindrical retaining portion.

6. The connector of claim 5, wherein:

the connecting portion is vertically in contact with and connected to the mating terminal fitting; and the resilient portion has a smaller vertical dimension than a part behind the resilient portion.

7. The connector of claim 5, wherein the embedded portion of the terminal fitting includes at least one transverse projection.

8. The connector of claim 5, wherein the embedded portion is substantially cylindrical and the retaining portion has a receiving surface extending in a direction crossing a circumferential direction of the embedded portion.

9. The connector of claim 5, wherein the retaining portion has an irregular shape.

10. The connector of claim 9, wherein the retaining portion includes two projections projecting out from the embedded portion in a width direction and at positions substantially opposite one another.

11. A connector, comprising:

a housing moded from a synthetic resin; and at least one terminal fitting having:

an embedded portion insert molded in the housing;

a connecting portion projecting out from the housing and being configured for connection to a mating terminal fitting, the connecting portion being substantially in the form of a plate having a thickness smaller than the embedded portion and a width larger than the embedded portion;

at least one seal in close contact with the embedded portion of the terminal fitting; and at least one resilient portion at a position between the connecting portion and the seal and outside the housing.

12. A connector, comprising:

a housing molded from a synthetic resin; and at least one terminal fitting having:

an embedded portion insert molded in the housing;

a connecting portion projecting out from the housing and being configured for connection to a mating terminal fitting;

at least one seal in close contact with the embedded portion of the terminal fitting;

at least one resilient portion at a position between the connecting portion and the seal and outside the housing; and at least one rigidity-reduced portion disposed behind the resilient portion and having a rigidity reduced from the embedded portion toward the connecting portion, the resilient portion being at a front end part of the rigidity-reduced portion.

13. The connector of claim 12, wherein a width of the rigidity-reduced portion is increased from the embedded portion toward the device-side connecting portion.

* * * * *